US007845900B2

(12) United States Patent
Roduner et al.

(10) Patent No.: US 7,845,900 B2
(45) Date of Patent: Dec. 7, 2010

(54) DIFFUSER FOR CENTRIFUGAL COMPRESSOR

(75) Inventors: Christian Roduner, Baden (CH); Bent Phillipsen, Baden-Ruetihof (CH); Douglas Robinson, Dietikon (CH)

(73) Assignee: ABB Turbo Systems AG, Baden (CH)

( * ) Notice: Subject to any disclaimer, the term of this patent is extended or adjusted under 35 U.S.C. 154(b) by 0 days.

(21) Appl. No.: 12/686,190

(22) Filed: Jan. 12, 2010

(65) Prior Publication Data

US 2010/0150709 A1 Jun. 17, 2010

Related U.S. Application Data

(63) Continuation of application No. PCT/EP2008/058941, filed on Jul. 9, 2008.

(30) Foreign Application Priority Data

Jul. 12, 2007 (EP) ..... 07112348

(51) Int. Cl.
*F04D 29/66* (2006.01)

(52) U.S. Cl. ..... 415/127; 415/206; 415/211.2

(58) Field of Classification Search ..... 415/119, 415/127, 206, 211.2
See application file for complete search history.

(56) References Cited

U.S. PATENT DOCUMENTS 1,534,721 A * 4/1925 Fritz ..... 415/195
3,006,603 A 10/1961 Caruso et al.

(Continued)

FOREIGN PATENT DOCUMENTS

DE 19502808 A1 8/1996

(Continued)

OTHER PUBLICATIONS

Notification Concerning Transmittal of International Preliminary Report on Patentability (Forms PCT/IB/326 and PCT/IB/373) and the Written Opinion of the International Searching Authority (Form PCT/ISA/237) issued in corresponding International Application No. PCT/EP2008/058941 dated Jan. 21, 2010, and the English Translation (Forms PCT/IB/338, PCT/IB/373 and PCT/ISA/237) dated Feb. 18, 2010.

(Continued)

*Primary Examiner*—Ninh H Nguyen
(74) *Attorney, Agent, or Firm*—Buchanan Ingersoll & Rooney PC

(57) ABSTRACT

A discharge region of a centrifugal compressor is provided. A scroll casing is asymmetrically formed in a circumferential direction and configured to be positioned in different angular positions in the circumferential direction. A vaned diffuser is configured to be positioned in different angular positions in the circumferential direction. The vaned diffuser includes a plurality of guide elements configured to be arranged in a distributed manner in the circumferential direction. Means are provided for positioning the vaned diffuser with regard to an angular position of the asymmetrically formed scroll casing. An angular spacing of two guide elements which are arranged adjacently to each other differs from an angular spacing of two other guide elements which are arranged adjacently to each other. By varying the angular spacings between two adjacent guide vanes of a diffuser along the circumference, the resonance vibration of the compressor can be reduced.

20 Claims, 2 Drawing Sheets

U.S. PATENT DOCUMENTS

| | | | | |
|---|---|---|---|---|
| 3,823,063 | A * | 7/1974 | Callahan et al. | 162/212 |
| 3,873,231 | A | 3/1975 | Callahan | |
| 5,454,690 | A * | 10/1995 | Wolfe et al. | 415/119 |
| 6,425,739 | B1 | 7/2002 | Ambler | |
| 2004/0244962 | A1 | 12/2004 | Tokunaga et al. | |
| 2006/0280596 | A1 | 12/2006 | Kim et al. | |

FOREIGN PATENT DOCUMENTS

| | | | |
|---|---|---|---|
| DE | 102005011482 | A1 | 9/2006 |
| EP | 1111191 | A | 6/2001 |
| EP | 1249615 | A | 10/2002 |
| EP | 1731070 | A1 | 12/2006 |
| EP | 1772596 | A2 | 4/2007 |

OTHER PUBLICATIONS

International Search Report (PCT/ISA/210) for PCT/EP2008/058941 mailed Nov. 12, 2008.
European Search Report for EP 07112348.3 dated Jan. 14, 2008.

* cited by examiner

DIFFUSER FOR CENTRIFUGAL COMPRESSOR

RELATED APPLICATIONS

This application claims priority as a continuation application under 35 U.S.C. §120 to PCT/EP2008/058941, which was filed as an International Application on Jul. 9, 2008 designating the U.S., and which claims priority to European Application 07112348.3 filed in Europe on Jul. 12, 2007. The entire contents of these applications are hereby incorporated by reference in their entireties.

FIELD

The present disclosure relates to the field of exhaust turbochargers, including exhaust turbochargers for charged internal combustion engines, for example. More particularly, the present disclosure relates to a discharge region of a centrifugal compressor of such exhaust gas turbochargers, wherein the discharge region is arranged downstream of a compressor impeller and includes a vaned diffuser and an asymmetrically formed scroll casing.

BACKGROUND INFORMATION

In modern turbochargers, single-stage centrifugal compressors with vaned diffusers are used to increase the induction pressure of the engine. In the diffuser, the kinetic energy of the medium which is to be compressed is converted into static pressure. The compressor impellers comprise a specific number of impeller blades, and the diffusers have guide vanes with prismatic, aerodynamic profiles (i.e., wedge-shaped or airfoil-shaped). As seen in the direction of the compressor axis, the guide vanes have a determined tangential angle at the leading edge (inlet angle), a determined tangential angle at the trailing edge (exit angle), and a determined spacing in the circumferential direction between two guide vanes which are arranged adjacently to each other.

When designing compressor stages, a compromise must constantly be found between the aerodynamic performance, the mechanical load and the development of noise by the compressor. Modern compressor stages with high specific swallowing capacities have long, thin impeller blades, the natural modes of which occur at low frequencies and can easily be excited and set in oscillation. A primary source of these excitations is a pressure potential field which is created by the guide vanes of the diffuser. On account of the geometrically regularly formed compressor impeller blades and diffuser guide vanes, resonance vibrations can occur which become effective as vibrational energy increases. On account of the high speed which is required for achieving the discharge pressure, the vibrations can lead in the extreme case to mechanical damage (high-cycle fatigue—HCF) in the compressor impeller blades.

EP 1 772 596 discloses a two-stage diffuser of a centrifugal compressor, in which a diffuser vane row is arranged in front of and behind the impeller blades of the compressor which are exposed to axial throughflow. The diffuser vane rows have a different number of guide vanes each in a lower and an upper half in order to reduce the vibration influence, as a result of the uneven vane concentration, upon the impeller blades which are arranged between the diffuser vane rows. The throughflow takes place in the axial direction, wherein the flow conditions in front of and behind the represented two-stage diffuser along the circumference are symmetrical. Such symmetrical flow conditions are necessary since the axial turbine, which is to be fed a flow which is as symmetrical as possible along the circumference, is arranged downstream of the diffuser.

U.S. Pat. No. 3,873,231 discloses a liquid pump with an impeller with a multiplicity of blades and a plurality of guide vanes which are arranged in a distributed manner along the circumference. The guide vanes in this case have an uneven distribution along the circumference in order to be able to avoid constant pressure patterns in the liquid which is to be pumped.

SUMMARY

An exemplary embodiment provides a discharge region of a centrifugal compressor, comprising: a scroll casing which is asymmetrically formed in a circumferential direction and configured to be positioned in different angular positions in the circumferential direction; a vaned diffuser configured to be positioned in different angular positions in the circumferential direction, the vaned diffuser including a plurality of guide elements configured to be arranged in a distributed manner in the circumferential direction; and means for positioning the vaned diffuser with regard to an angular position of the asymmetrically formed scroll casing. An angular spacing of two guide elements which are arranged adjacently to each other differs from an angular spacing of two other guide elements which are arranged adjacently to each other.

BRIEF DESCRIPTION OF THE DRAWINGS

Additional refinements, advantages and features of the present disclosure are described in more detail below with reference to exemplary embodiments illustrated in the drawings, which illustrate exemplary embodiments of a diffuser of a centrifugal compressor, in which.

DETAILED DESCRIPTION

Exemplary embodiments of the present disclosure provide an improved discharge region of a centrifugal compressor in which a diffuser, in interaction with the asymmetrically formed scroll casing which is arranged downstream of the guide vanes of the diffuser, and also with the impeller blades of the centrifugal compressor impeller, causes resonance vibrations which are as low as possible.

Exemplary embodiments achieve this advantageous aspect by varying the angular spacings between two adjacently arranged guide vanes of the diffuser varying. The diffuser, which is irregularly formed as a result, is arranged in a defined angular position with regard to the scroll casing which can be positioned in different angular positions in the circumferential direction.

According to an exemplary embodiment, individual guide vane pairs can have an angular spacing which differs from the remaining guide vane pairs.

In a further exemplary embodiment, a plurality of guide vane pairs, which are arranged next to each other or distributed regularly or irregularly along the circumference, can have the same angular spacing but an angular spacing which is different from the angular spacing of the remaining guide vane pairs.

In another exemplary embodiment, a plurality of groups of guide vane pairs can have the same angular spacing. These guide vane pairs of such groups can be arranged in a manner in which they adjoin each other or in a manner in which they are distributed over the circumference.

In a further exemplary embodiment, all the guide vane pairs can have a different angular spacing.

The shape, length, inlet angle and exit angle as well as the inlet radius and exit radius of the guide vanes, with regard to the compressor axis, can be the same for all the guide vanes or can be different for some or all of the guide vanes in the axial direction as well as in the circumferential direction.

Such diffusers which are irregularly formed according to exemplary embodiments of the present disclosure can be designed in a single-stage or multistage form, wherein in the case of a plurality of stages, the diffusers are arranged one behind the other in the radial direction, that is to say concentrically with regard to the compressor axis.

Figure 1:
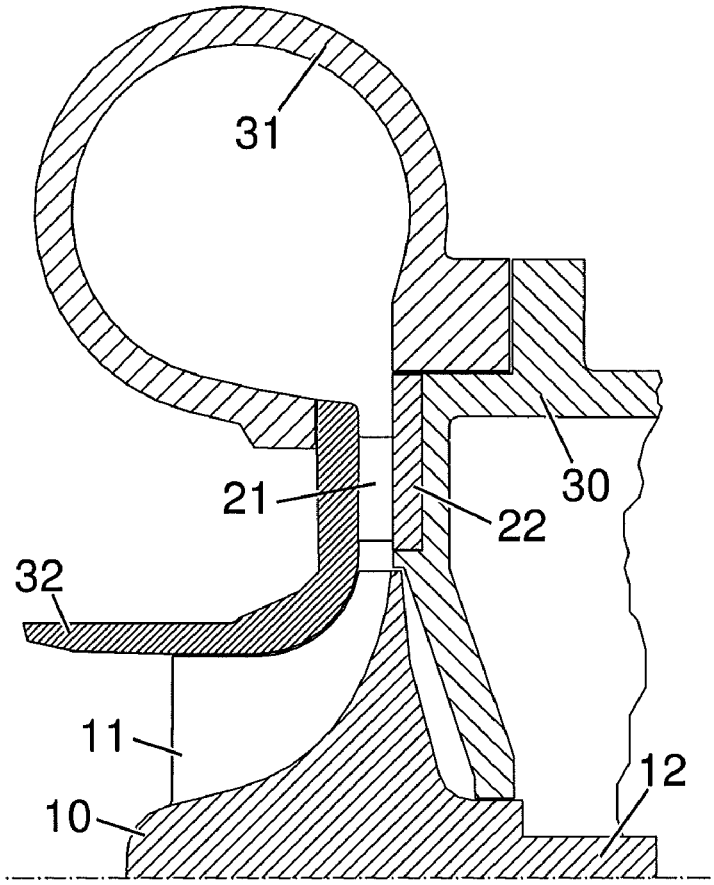
FIG. 1 shows a section of an exemplary centrifugal compressor along the compressor axis with a vaned diffuser.
Figure 4:
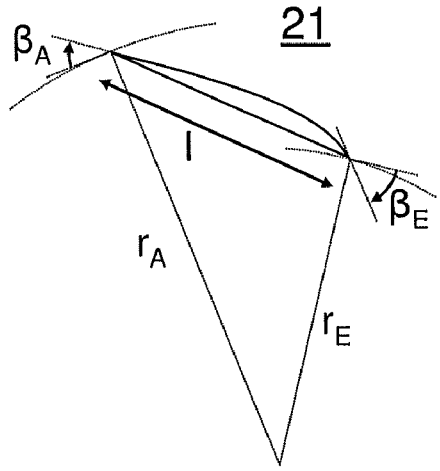
FIG. 4 shows an individual guide vane of an exemplary diffuser according to at least one embodiment of the present disclosure.

FIG. 1 shows a sectional view of a compressor section of an exemplary exhaust gas turbocharger through the shaft axis. The compressor comprises a compressor impeller. The compressor impeller is arranged on the shaft 12 and comprises a hub 10 and impeller blades 11 which are arranged on the hub 10. The impeller blades 11 can be divided into main blades and intermediate blades, wherein the main blades extend over the entire length of the flow passage which is delimited by the hub 10 and the adjoining casing section, while the intermediate blades are formed in a shortened manner and have a set-back leading edge. In this case, one or more intermediate blades per main blade can be arranged. The compressor impeller is arranged in a compressor casing, which comprises a plurality of sections, such as a scroll casing 31 and an intake casing 32, for example. A bearing housing 30, which contains the bearing of the shaft, is located between the compressor and the associated turbine. The previously mentioned flow passage in the region of the compressor is delimited by means of the compressor casing. In the region of the compressor impeller, the hub 10 of the compressor impeller takes care of the radially inner boundary, wherein the impeller blades 11 of the compressor impeller are arranged in the flow passage. The diffuser is arranged downstream of the compressor impeller in the flow direction of the medium which is to be compressed. As mentioned above, the diffuser serves to decelerate the flow which is accelerated by means of the compressor impeller. This is carried out, on the one hand, by means of guide vanes 21 of the diffuser and, on the other hand, by means of the scroll casing 31 from which the compressed medium is fed to the combustion chambers of an internal combustion engine. The guide vanes 21 of the diffuser are connected on one side or on both sides of the flow passage to a diffuser wall 22 or casing section.

According to an exemplary embodiment of the present disclosure, the diffuser has a plurality of guide vanes 21. The guide vanes 21 can have different angular spacings from each other. As used herein, the angle between the leading edges of two guide vanes 21 which are arranged adjacently to each other is referred to as the "angular spacing." As used herein, the angle between two other corresponding points of two guide vanes 21 which are arranged adjacently to each other can optionally also be referred to as the "angular spacing," for example when the guide vanes have differently formed inlet angles or the leading edges are located on different radii. In this case, for example, the angle between the trailing edges or the angle between the profile middle points can be referred to as the "angular spacing."

According to an exemplary embodiment of the present disclosure, the angular spacings between guide vanes which are arranged adjacently to each other are not identical over the entire circumference. In this case, there is a plurality of possibilities of realizing diffusers with varying angular spacings between the guide vanes, as described below.

Figure 2:
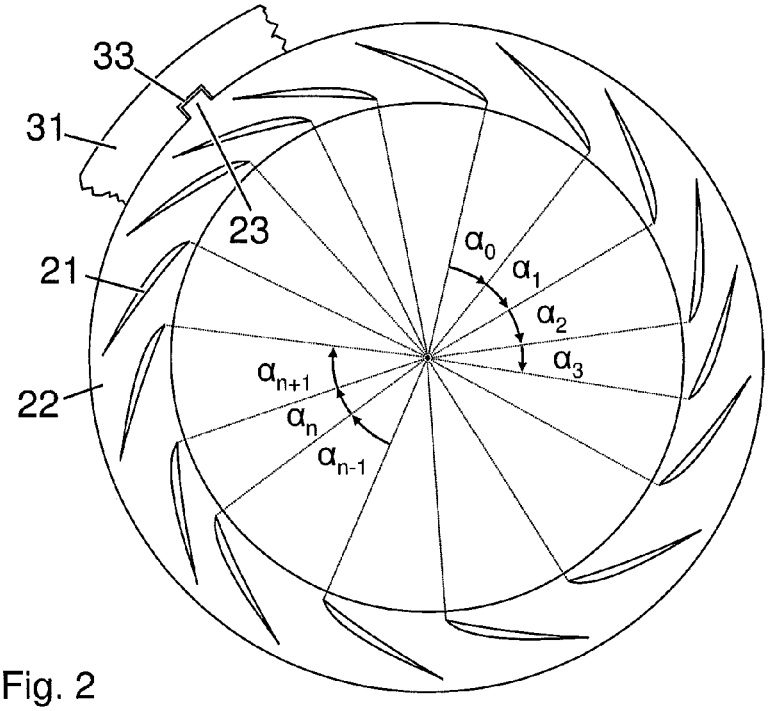
FIG. 2 shows a section of an exemplary diffuser perpendicular to the compressor axis, with irregularly arranged guide vanes.

In an exemplary embodiment illustrated in FIG. 2, the angular spacings $\alpha_x$ ($0<x<\infty$; $n<\infty$) for all the pairs of guide vanes 21 of the diffuser which are arranged adjacently to each other are different. Accordingly, in the exemplary embodiment illustrated in FIG. 2, no two of the sixteen angular spacings $\alpha_x$ between the sixteen guide vane pairs are identical to one another. Examples of the values for the individual angular spacings $\alpha_x$ of the exemplary embodiment illustrated in FIG. 2 can be gathered from the following Table 1:

TABLE 1

| Angular spacings FIG. 2 | |
|---|---|
| $\alpha_0$ | 25° |
| $\alpha_1$ | 21° |
| $\alpha_2$ | 23° |
| $\alpha_3$ | 17° |
| | 20° |
| | 29° |
| | 28° |
| | 27° |
| $\alpha_{n-1}$ | 30° |
| $\alpha_n$ | 18° |
| $\alpha_{n+1}$ | 26° |
| | 19° |
| | 22° |
| | 16° |
| | 15° |
| | 24° |

The different angular spacings $\alpha_x$, as can be gathered from the above table, are irregularly distributed to all the pairs of guide vanes 21 in the exemplary embodiment illustrated in FIG. 2. Alternatively, the angular spacings $\alpha_x$ could also increase or decrease regularly in a circumferential direction, or first increase and the decrease again. Particularly advantageous results can be achieved if the angular spacings $\alpha_x$ become larger and smaller, following a harmonic function, for example the sine function.

Figure 3:
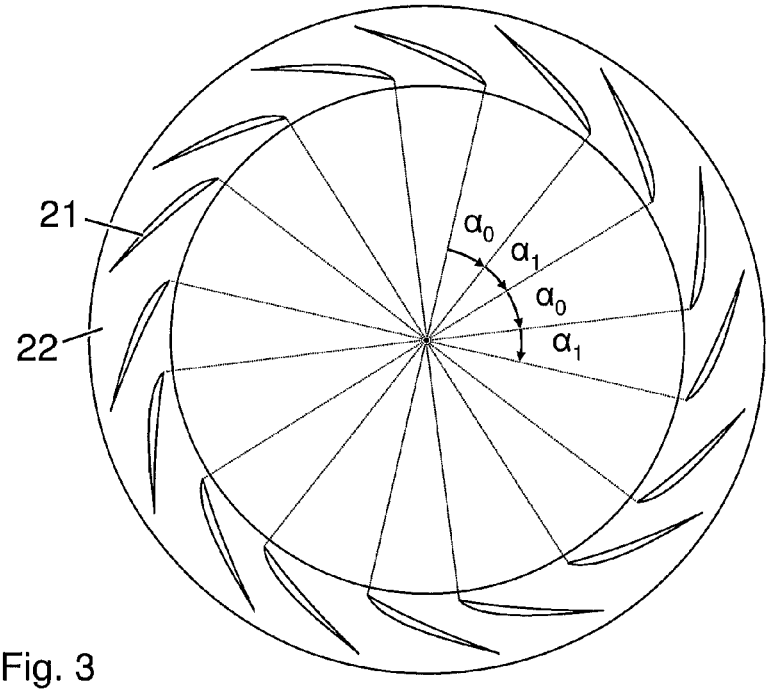
FIG. 3 shows a section of an exemplary diffuser perpendicular to the compressor axis, with angular spacings which alternate in the circumferential direction between the guide vanes which are arranged adjacently to each other in each case.

In another exemplary embodiment illustrated in FIG. 3, two angular spacings $\alpha_0$ and $\alpha_1$ are distributed to the pairs of guide vanes in an alternating manner along the circumference. The values for the individual angular spacings of the exemplary embodiment illustrated in FIG. 3 can again be gathered from the following Table 2:

TABLE 2

| Angular spacings FIG. 3 | |
|---|---|
| $\alpha_0$ | 25° |
| $\alpha_1$ | 20° |

Additional embodiments are also possible in accordance with the present disclosure. For example, all the angular spacings $\alpha_x$ can be identical except for one or a few of them. Groups of identical angular spacings $\alpha_x$ can be formed. These pairings of guide vanes 21 with identical angular spacings $\alpha_x$ can be arranged in a manner in which they lie adjacent to each other or are separated from each other.

In the case of diffusers with guide vanes 21 with different angular spacings $\alpha_x$, based on measurements, a reduction of resonance vibrations of up to 50 percent, as compared with a regularly vaned diffuser, was proven to be achieved.

The individual guide vanes of the diffuser could optionally differ from each other in shape, length, inlet angle and exit angle, as well as inlet radius and exit radius in order to introduce additional inequalities into the diffuser. The different design in this case can be effected both in the axial direction (with regard to the compressor axis), that is to say in the direction of the blade height, as well as in the circumferential direction. In this case, all or only a few of the guide vanes 21 can be differently formed or arranged.

Such diffusers, which are irregularly formed according to exemplary embodiments of the present disclosure, can be designed in single-stage or multistage form, wherein in the case of a plurality of stages these are arranged one behind the other in the radial direction, that is to say concentrically with regard to the compressor axis.

The diffuser, which can be irregularly formed in the circumferential direction, can be positioned in a fixed angular position with regard to the scroll casing 31 which is asymmetrically formed in the circumferential direction. Moreover, the value of the different angular spacings $\alpha_x$ and their distribution along the circumference are geared to the asymmetrically formed scroll casing 31 downstream of the guide vanes 21. For example, the angular spacings $\alpha_x$ can increase along the circumference similar to the radius of the scroll casing 21, or a guide vane pair, which is arranged in the region of the start of the scroll tongue, can have an angular spacing $\alpha_x$ which differs from the remaining guide vane pairs.

Since the scroll casing 31 can be positioned in different angular positions along the circumference, it is ensured with positioning means that the diffuser is located in each case in the intended angular position to the scroll casing 31. According to an exemplary embodiment, the intended angular position in this case is advantageously set so that minimum resonance vibration is created during operation. This angular position of the diffuser to the scroll casing with minimum creation of resonance vibration can be optionally calculated or experimentally determined. An example of a positioning means is indicated in FIG. 2, in which a positioning cam 23 is arranged on the radially outer edge of the diffuser wall 22 and engages in a positioning slot 33 in the scroll casing 31. The present disclosure is not limited to the example of the positioning means illustrated in FIG. 2, as other form-fitting positioning means are conceivable. For example, a positioning pin can be arranged in holes which are provided on two sides, such as opposing sides of the diffuser wall 22 and scroll casing 31. Indirect positioning via a third component, for example the intake casing 32 or the bearing housing 30, is also conceivable.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

10 Compressor impeller (hub)
11 Compressor impeller blades
12 Shaft
21 Guide element of the diffuser (guide vane)
22 Wall of the diffuser
23 Positioning cam
30 Bearing housing
31 Scroll casing
32 Intake casing
33 Positioning slot
$\alpha_x$ Angular spacing between two diffuser guide vanes
$\beta_A$ Exit angle of the diffuser guide vane
$\beta_E$ Inlet angle of the diffuser guide vane
$r_A$ Exit radius of the diffuser guide vane
$r_E$ Inlet radius of the diffuser guide vane
l Length of the diffuser guide vane

What is claimed is:

1. A discharge region of a centrifugal compressor, comprising:

a scroll casing which is asymmetrically formed in a circumferential direction and configured to be positioned in different angular positions in the circumferential direction;

a vaned diffuser configured to be positioned in different angular positions in the circumferential direction, the vaned diffuser including a plurality of guide elements configured to be arranged in a distributed manner in the circumferential direction; and means for positioning the vaned diffuser with regard to an angular position of the asymmetrically formed scroll casing, wherein an angular spacing of two guide elements which are arranged adjacently to each other differs from an angular spacing of two other guide elements which are arranged adjacently to each other.

2. The discharge region of a centrifugal compressor as claimed in claim 1, wherein a plurality of pairs of the guide elements which are arranged adjacently to each other have a different angular spacing than other guide elements among the plurality of guide elements which are arranged adjacently to each other.

3. The discharge region of a centrifugal compressor as claimed in claim 2, wherein at least two pairs of the guide elements which are arranged adjacently to each other have a first angular spacing, and at least two other pairs of the guide elements which are arranged adjacently to each other have a second angular spacing, which is different from the first angular spacing.

4. The discharge region of a centrifugal compressor as claimed in claim 3, wherein a plurality of the guide elements which are arranged adjacently to each other have the same angular spacing.

5. The discharge region of a centrifugal compressor as claimed in claim 4, wherein the pairs of the guide elements with the same angular spacings are assembled from different guide elements and are arranged at a distance from each other.

6. The discharge region of a centrifugal compressor as claimed in claim 3, wherein the pairs of the guide elements with the same angular spacings are assembled from different guide elements and are arranged at a distance from each other.

7. The discharge region of a centrifugal compressor as claimed in claim 3, wherein the angular spacings between guide elements which are arranged adjacently to each other are distributed along the circumferential direction to follow a harmonic function.

8. The discharge region of a centrifugal compressor as claimed in claim 2, wherein each pair of guide elements which are arranged adjacently to each other has a different angular spacing than each other pair of the guide elements which are arranged adjacently to each other.

9. The discharge region of a centrifugal compressor as claimed in claim 8, wherein the angular spacings between guide elements which are arranged adjacently to each other are distributed along the circumferential direction to follow a harmonic function.

10. The discharge region of a centrifugal compressor as claimed in claim 2, wherein the angular spacings between guide elements which are arranged adjacently to each other are distributed along the circumferential direction to follow a harmonic function.

11. The discharge region of a centrifugal compressor as claimed in claim 10, wherein at least one guide element differs in at least one of length in a flow direction and shape from each other one of the guide elements.

12. The discharge region of a centrifugal compressor as claimed in claim 1, wherein at least one guide element differs in at least one of length in a flow direction and shape from each other one of the guide elements.

13. The discharge region of a centrifugal compressor as claimed in claim 12, wherein at least one guide element has at least one of a different inlet angle, exit angle, inlet radius and exit radius than each other one of the guide elements.

14. The discharge region of a centrifugal compressor as claimed in claim 1, wherein at least one guide element has at least one of a different inlet angle, exit angle, inlet radius and exit radius than each other one of the guide elements.

15. An exhaust gas turbocharger comprising a centrifugal compressor with a discharge region as claimed in claim 1.

16. The discharge region of a centrifugal compressor as claimed in claim 1, wherein at least two pairs of the guide elements which are arranged adjacently to each other have a first angular spacing, and at least two other pairs of the guide elements which are arranged adjacently to each other have a second angular spacing, which is different from the first angular spacing.

17. The discharge region of a centrifugal compressor as claimed in claim 1, wherein a plurality of the guide elements which are arranged adjacently to each other have the same angular spacing.

18. The discharge region of a centrifugal compressor as claimed in claim 17, wherein the pairs of the guide elements with the same angular spacings are assembled from different guide elements and are arranged at a distance from each other.

19. The discharge region of a centrifugal compressor as claimed in claim 1, wherein at least one guide element differs in at least one of length in a flow direction and shape from at least one of the guide elements.

20. The discharge region of a centrifugal compressor as claimed in claim 1, wherein at least one guide element has at least one of a different inlet angle, exit angle, inlet radius and exit radius than at least one other one of the guide elements.

* * * * *